US011319618B2

(12) United States Patent
Deng et al.

(10) Patent No.: US 11,319,618 B2
(45) Date of Patent: May 3, 2022

(54) TI(C,N)-BASED SUPERHARD METAL COMPOSITE MATERIAL AND PREPARATION METHOD THEREOF

(71) Applicant: CHONGQING UNIVERSITY OF ARTS AND SCIENCES, Chongqing (CN)

(72) Inventors: Ying Deng, Chongqing (CN); Shan Jiang, Chongqing (CN); Yanhua Zhang, Chongqing (CN); Taibin Wu, Chongqing (CN); Qiaowang Chen, Chongqing (CN); Hui Yan, Chongqing (CN); Ling Deng, Chongqing (CN); Hui Chen, Chongqing (CN)

(73) Assignee: CHONGQING UNIVERSITY OF ARTS AND SCIENCES, Chongqing (CN)

( * ) Notice: Subject to any disclaimer, the term of this patent is extended or adjusted under 35 U.S.C. 154(b) by 141 days.

(21) Appl. No.: 16/975,715

(22) PCT Filed: Dec. 24, 2019

(86) PCT No.: PCT/CN2019/127855
§ 371 (c)(1),
(2) Date: Aug. 26, 2020

(87) PCT Pub. No.: WO2020/135404
PCT Pub. Date: Jul. 2, 2020

(65) Prior Publication Data

US 2021/0002745 A1 Jan. 7, 2021

(30) Foreign Application Priority Data

Dec. 29, 2018 (CN) ..... 201811633555.4

(51) Int. Cl.
*C22C 29/04* (2006.01)
*B22F 7/00* (2006.01)
(Continued)

(52) U.S. Cl.
CPC ..... *C22C 29/04* (2013.01); *B22F 7/008* (2013.01); *B22F 9/04* (2013.01); *C22C 1/051* (2013.01);
(Continued)

(58) Field of Classification Search
CPC ..... C22C 29/04
See application file for complete search history.

(56) References Cited

U.S. PATENT DOCUMENTS 5,308,376 A 5/1994 Oskarsson
8,765,272 B2 * 7/2014 Tamura ..... C22C 29/04 428/408
(Continued)

FOREIGN PATENT DOCUMENTS

CN 105283570 1/2016
CN 106232846 12/2016
(Continued)

OTHER PUBLICATIONS

"International Search Report (Form PCT/ISA/210) of PCT/CN2019/127855", dated Mar. 27, 2020, with English translation thereof, pp. 1-5.

*Primary Examiner* — Christopher S Kessler
(74) *Attorney, Agent, or Firm* — JCIPRNET

(57) ABSTRACT

The disclosure relates to a method for preparing Ti(C,N)-based superhard metal composite materials, with Ti(C,N) powder and (W,Mo,Ta)(C,N) powder as main raw materials and Co powder as binding phase for preparation, thereby obtaining a material in which a microstructure is a double-core rim structure that has both a black core rim and a white
(Continued)

core rim. The material has a complete and evenly distributed double-core rim structure. In the condition that the ensured hardness of the material is not reduced and even slightly increased, the toughness of the material is significantly improved, wherein the fracture toughness of the material is in the range of 11.3 to 12.5 $MPa \cdot m^{1/2}$.

5 Claims, 4 Drawing Sheets

(51) Int. Cl.
*B22F 9/04* (2006.01)
*C22C 1/05* (2006.01)
*C22C 29/00* (2006.01)

(52) U.S. Cl.
CPC ..... *C22C 29/005* (2013.01); *B22F 2009/043* (2013.01); *B22F 2998/10* (2013.01); *B22F 2999/00* (2013.01)

(56) References Cited

U.S. PATENT DOCUMENTS

| | | | | |
|---|---|---|---|---|
| 2017/0088921 | A1* | 3/2017 | Takesawa | B22F 9/04 |
| 2020/0048747 | A1* | 2/2020 | Michiuchi | C22C 29/08 |

FOREIGN PATENT DOCUMENTS

| | | |
|---|---|---|
| CN | 108950342 | 12/2018 |
| CN | 109457162 | 3/2019 |
| JP | H08199283 | 8/1996 |

* cited by examiner

TI(C,N)-BASED SUPERHARD METAL COMPOSITE MATERIAL AND PREPARATION METHOD THEREOF

BACKGROUND

Technical Field

The disclosure relates to the technical field of metal-based composite materials, in particular to a preparation method of Ti(C,N)-based superhard metal composite materials.

Description of Related Art

Ti(C,N)-based superhard composite materials are a type of valuable new materials developed in combination with vanadium and titanium resources. They have the advantages of low density, high red hardness, high wear resistance, low friction coefficient and low thermal conductivity and so on. Moreover, Ti(C,N)-based superhard composite materials have perfect chemical stability, and because of their low price, they are currently the best substitute for common WC cemented alloy materials.

Ti(C,N)-based superhard composite material is a polycrystalline sintered material, which is formed by metal bonding phase (Co/Ni) and hard phase Ti(C,N). The main shortcoming of such material is its high level of brittleness and insufficient toughness. Studies have shown that the addition of metal carbides such as WC, $Mo_2C$, and TaC can improve the wettability of metals relative to the ceramic phase at varying degrees, which is beneficial to the improvement of the toughness of the ceramic body. Therefore, in the related art, metal carbides such as WC, $Mo_2C$ and TaC, etc. are usually added to improve the toughness of the material. The Ti(C,N)-based superhard composite product formed by such material has a typical single-core rim structure with black Ti(C,N) as the core under observation by using scanning electron microscope backscattered electrons (SEM-BSE), as shown in FIG. 4. Specifically, the formation of the core rim structure is controlled by the dissolution-precipitation mechanism. During the solid phase sintering process, metal carbides such as $Mo_2C$, TaC, and WC are sequentially dissolved into the metal bonding phase Ni/Co. When the concentration of heavy metal elements in the bonding phase reaches saturation, (Ti, M)(C, N) precipitated phases (M is heavy metals W, Mo, Ta, etc.) occur, and the surface coated on the Ti (C, N) particles is formed into a white rim. In the subsequent liquid phase sintering process, the heavy metal elements continue to dissolve-precipitate, but because the specific gravity is lower than before, the SEM-BSE morphology of the precipitated phase is gray, that is, the gray rim phase. In this single core rim structure, the composition and lattice constants between the core and the rim are quite different, and it is easy to cause interface stress and component segregation during the multiphase sintering process, resulting in structural defects. As such, the strength and toughness of the product cannot be effectively ensured, which restricts the application of such material in advanced engineering, and which is also the main reason why such material cannot completely replace WC alloy materials.

In recent years, domestic and foreign scholars not only conduct research on material toughening methods, such as phase transformation strengthening, fiber toughening, fine crystal strengthening, nano modification, etc., but also a large number of studies have been launched in the optimization of the microstructure of the Ti(C,N) based superhard composite materials. However, there is a lack of focus in the optimization methods for the microstructure of the material on reducing the lattice constant difference between the core and the rim, and the abovementioned optimization methods cannot effectively solve the defects of the core and rim structure, which restricts the effective improvement of the performance of the superhard metal composite material.

SUMMARY

The purpose of the disclosure is to provide a method for preparing Ti(C,N)-based superhard metal composite material. The composite material obtained by this method has a double-core rim structure, and the strength and toughness of the material are significantly improved.

To achieve the above purpose, the technical solution of the disclosure is as follows.

In a preparation method of Ti(C,N)-based superhard metal composite material, Ti(C,N) powder and (W, Mo, Ta)(C,N) powder are adopted as the main raw materials. The (W, Mo, Ta)(C,N) powder is added into Ti(C,N) powder, and Co powder is adopted as the binding phase. Then molding and sintering are performed for preparation. Specific steps are as follows: Ti(C,N) powder and (W, Mo, Ta) (C, N) powder are weighed and mixed with Co powder, paraffin wax is added, then high energy ball milling, drying, sieving, compression molding, and sintering are performed.

The mass fractions of the Ti(C,N) powder, the (W, Mo, Ta) (C,N) powder and the Co powder are 40-50%, 40-50%, and 10-20%, respectively.

The fineness of the Ti (C, N) powder, the (W, Mo, Ta) (C, N) powder, and the Co powder are 0.5 to 3 μm.

The amount of the paraffin wax to be added is calculated based on 3 to 5% of the total mass of the mixed powder consisting of the Ti(C,N) powder, the (W, Mo, Ta) (C, N) powder and the Co powder.

The above high-energy ball milling is performed by using a planetary ball mill, wherein a ball-to-material ratio is 3 to 6:1, a rotation speed is 300 to 500 r/min, and the ball milling is performed for 48 to 90 hours.

The above-mentioned sieving is performed by using a 60 mesh sieve specifically.

The above-mentioned press-forming is performed by using a hydraulic press specifically, and the pressing force is 200 to 230 KN.

The above-mentioned sintering is carried out in sequence specifically according to the following conditions: sintering in solid phase at 1150° C., maintaining the temperature for 60 to 80 minutes, sintering in liquid phase at 1400° C. to 1450° C., maintaining the temperature for 60 to 80 minutes, then filling in with nitrogen at 7 to 10 MPa, then maintaining the temperature for 60 to 90 minutes, maintaining a nitrogen atmosphere and then cooling to room temperature.

Preferably, the above-mentioned (W, Mo, Ta) (C, N) powder is obtained by the following steps:

Weigh $WO_3$, $MoO_3$, $Ta_2O_5$ and carbon black respectively for batching, then add PEG-4000 polyethylene glycol, perform ball milling by using a planetary ball mill, and then the slurry is placed into a graphite boat after spray drying, and carbothermal nitridation reduction reaction is performed in a vacuum tube furnace, then $N_2$ atmosphere is adopted, and finally the (W, Mo, Ta) (C, N) powder is obtained.

Preferably, the above (W, Mo, Ta) (C, N) powder is obtained by the following steps:

Weigh $WO_3$, $MoO_3$, $Ta_2O_5$ and carbon black respectively for batching to obtain a mixed material with four components, then add PEG-4000 polyethylene glycol which accounts for 4 to 10% of the total mass of the above four-component mixed material, and use a planetary ball mill for ball milling, wherein the ball milling medium is n-hexane and the milling ball is a zirconia ball of 5 to 7 mm, the ball material mass ratio is 8 to 10:1, the rotation speed is 200 to 300 r/min, the ball milling is performed for 4 to 6 hours. After the ball milling is performed, the slurry is spray dried and then put into the graphite boat, and the carbothermal nitridation reduction reaction is performed in the vacuum tube furnace, wherein $N_2$ atmosphere is adopted, the flow rate is 500 to 600 ml/min, the pressure in the furnace is 0.1 to 0.2 MPa, the reduction temperature is 1300° C. to 1600° C., the reduction time is 3 to 4 hours, and finally the (W, Mo, Ta) (C,N) powder is obtained.

Specifically, in the step of weighing $WO_3$, $MoO_3$, $Ta_2O_5$ and carbon black respectively for batching, the mass fractions of $WO_3$, $MoO_3$, $Ta_2O_5$, and carbon black are 20 to 30%, 20 to 30%, 10 to 15%, and 25 to 50%, respectively.

Preferably, the powder purity of the above $WO_3$, $MoO_3$, $Ta_2O_5$, and the carbon black is >99.9%, and the average particle size thereof is 10 to 50 μm.

In more detail, the preparation method of the above Ti(C,N)-based superhard metal composite material uses the following raw materials and proceeds in the following steps:

Specifically, the preparation method of the above Ti(C, N)-based superhard metal composite material adopts the following raw materials and is performed through the following steps:

(1) Based on an amount with mass fractions of 20-30%, 20-30%, 10-15% and 25-50%, respectively, weigh the $WO_3$, $MoO_3$, $Ta_2O_5$, and the carbon black having a purity of >99.9% and an average particle size of 10 to 50 μm for batching to obtain a four-component mixed material. Then add PEG-4000 polyethylene glycol which accounts for 4 to 10% of the total mass of the above four-component mixed material, and use a planetary ball mill for ball milling, wherein the ball milling medium is n-hexane and the milling ball is a zirconia ball of 5 to 7 mm, the ball material mass ratio is 8 to 10:1, the rotation speed is 200 to 300 r/min, and the ball milling is performed for 4 to 6 hours. After the ball milling is performed, the slurry is spray dried and then put into the graphite boat, and the carbothermal nitridation reduction reaction is performed in the vacuum tube furnace, wherein $N_2$ atmosphere is adopted, the flow rate is 500 to 600 ml/min, the pressure in the furnace is 0.1 to 0.2 MPa, the reduction temperature is 1300° C. to 1600° C., the reduction time is 3 to 4 hours, and finally the (W, Mo, Ta) (C,N) powder is obtained.

(2) Based on an amount with mass fractions of 40-50%, 40-50%, and 10-20%, respectively, weigh the Ti(C,N) powder and the (W, Mo, Ta) (C, N) powder with fineness of 0.5 to 3 μm and mix them with the Co powder, and then add the paraffin wax which accounts for 3 to 5% of the total mass of the mixed powder consisting of the Ti (C, N) powder, the (W, Mo, Ta) (C, N) powder and the Co powder. Thereafter, the high-energy ball milling is performed by using a planetary ball mill, wherein a ball-to-material ratio is 3 to 6:1, a rotation speed is 300 to 500 r/min, and the ball milling is performed for 48 to 90 hours. After drying, sieving is performed by using a 60 mesh sieve. Then press-forming is performed by using a hydraulic press, and the pressing force is 200 to 230 KN. Then sintering is carried out in solid phase at 1150° C., maintain the temperature for 60 to 80 minutes, sintering is carried out in liquid phase at 1400° C. to 1450° C., maintain the temperature for 60 to 80 minutes, then fill in with nitrogen at 7 to 10 MPa, then maintain the temperature for 60 to 90 minutes, maintain a nitrogen atmosphere and then cool to room temperature. At the stage, the sintering is completed.

The microstructure of the Ti(C,N)-based superhard metal composite material prepared by the disclosure is a double-core rim structure having both a black-core rim and a white-core rim. Specifically, the microstructure of the material is a diversified double-core rim structure with black core-white rim/white core-gray rim, black core-gray rim/white core-gray rim, black core-white inner rim-gray outer rim/white core-gray rim, etc. Preferably, the microstructure of the material is a double-core rim structure that simultaneously has a black core-white inner rim-gray outer rim/white core-gray rim.

The disclosure has the following advantageous effects:

The disclosure provides a Ti(C,N)-based superhard metal composite material, which has a complete and uniformly distributed double-core rim structure that has greatly improved toughness in condition that the guaranteed hardness is not reduced and even slightly increased. The fracture toughness value of the above structure ranges from 11.3 to 12.5 $MPa \cdot m^{1/2}$. Specifically, the structure is prepared by adding (W, Mo, Ta) (C, N) into the Ti (C, N) matrix, thereby obtaining the Ti(C,N)-based superhard metal composite material with the dual-core rim structure (i.e., double-core rim structure) with both black core and white core. The material of this structure reduces the number of brittle black core Ti(C,N), the white core has almost the same composition as the rim phase, thereby reducing the difference between the core and rim to a maximum degree and optimizing the structure of the Ti(C,N)-based superhard metal composite material. The complete double-core rim structure of the Ti(C,N)-based superhard metal composite material increases the interface bonding strength of the hard phase and the bonding phase, reduces the interface stress and component segregation, thereby reducing defects and improving the strength and toughness of the material. Moreover, due to the different structure of the two core rims, the stress transmission is relieved, the crack is deflected, such that the crack expansion is effectively prevented, and the hard phase grain growth is prevented. As such, the purpose of improving the toughness of the Ti(C,N)-based superhard metal composite material can be achieved. Compared with the Ti(C,N)-based superhard metal composite material with a conventional structure, the strength and toughness of the Ti(C,N)-based superhard metal composite material having the double-core rim structure in the disclosure are significantly improved. The disclosure provides a new idea for the development of Ti(C,N)-based superhard metal composite material, can effectively solve the problem of the exhaustion of tungsten resources, and has high application value. In addition, the method of the disclosure realizes the smooth progress of the preparation process, ensures that the product has excellent strength and toughness, and at the same time avoids the situations where the preparation process cannot be controlled well, which consequently leads to the product with toughness improved only while the hardness cannot be ensured, or the product has more grain boundaries, non-uniformed composition, dispersed elements, unsatisfactory performance, and even a pore structure with poor density and thus the performance of the product cannot be ensured.

DESCRIPTION OF THE EMBODIMENTS

Figure 1:
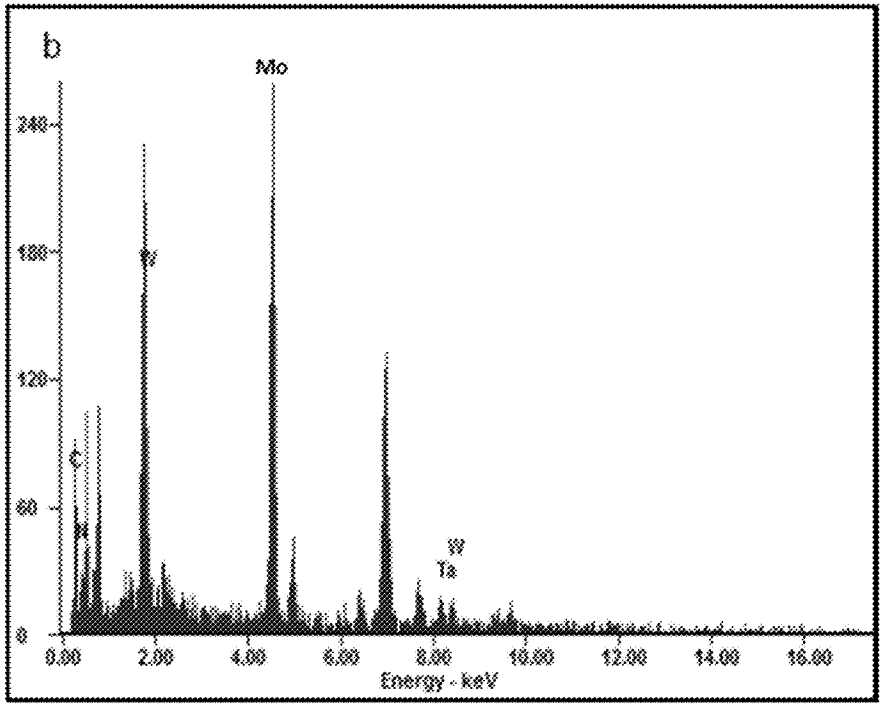
FIG. 1 is an SEM morphology and energy spectrum of (Ta, Mo, W) (C, N) solid solution powder prepared in Example 1 of the disclosure.
Figure 1:
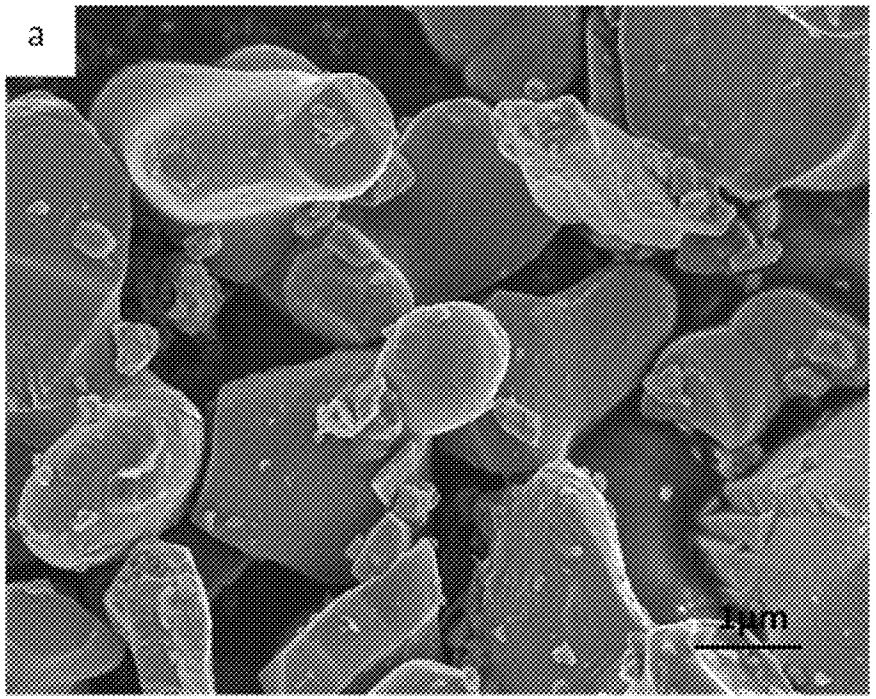

The technical solutions in the disclosure will be described clearly and thoroughly in combination with the embodiments of the disclosure. Obviously, the following embodiments are only a part of the embodiments, rather than all the embodiments, of the disclosure.

Example 1

A preparation method of Ti(C,N)-based superhard metal composite material, which is carried out according to the following steps in sequence:

(1) Based on an amount with mass fractions of 20%, 20%, 10%, and 50%, respectively, weigh the $WO_3$, $MoO_3$, $Ta_2O_5$, and the carbon black having a purity of >99.9% and an average particle size of 10 to 50 μm for batching to obtain a four-component mixed material. The mixed material is placed in a zirconia ceramic tank. Then add PEG-4000 polyethylene glycol which accounts for 4% of the total mass of the above four-component mixed material, and use a planetary ball mill for ball milling, wherein the ball milling medium is n-hexane and the milling ball is a zirconia ball of 5 mm, the ball material mass ratio is 10:1, the rotation speed is 200 r/min, the ball milling is performed for 4 hours. After the ball milling is performed, the slurry is spray dried and then put into the graphite boat, and the carbothermal nitridation reduction reaction is performed in the vacuum tube furnace, wherein $N_2$ atmosphere is adopted, the flow rate is 600 ml/min, the pressure in the furnace is 0.2 MPa, the reduction temperature is 1500° C., the reduction time is 3 hours, and finally the (W, Mo, Ta) (C,N) powder is obtained.

(2) Based on an amount with mass fractions of 40%, 47%, and 13%, respectively, weigh the $Ti(C_{0.5},N_{0.5})$ powder and the (W, Mo, Ta) (C, N) powder with fineness of 0.5 to 3 μm and mix them with the Co powder, and then add the paraffin wax which accounts for 5% of the total mass of the mixed powder consisting of the Ti $(C_{0.5},N_{0.5})$ powder, the (W, Mo, Ta) (C, N) powder and the Co powder. Thereafter, the high-energy ball milling is performed by using a planetary ball mill, wherein a ball-to-material ratio is 6:1, a rotation speed is 500 r/min, and the ball milling is performed for 48 hours. After drying, sieving is performed by using a 60 mesh sieve. Then press-forming is performed by using a hydraulic press, and the pressing force is 200 KN. Then sintering is carried out in solid phase at 1150° C., maintain the temperature for 60 minutes, sintering is carried out in liquid phase at 1450° C., maintain the temperature for 80 minutes, then fill in with nitrogen at 10 MPa, then maintain the temperature for 90 minutes, maintain a nitrogen atmosphere and then cool to room temperature in a natural condition.

In this Example 1, specifically a YXQM-4L planetary ball mill is used for high-energy ball milling; a JEOL-6490LV scanning electron microscope manufactured by Japanese company is used to observe the morphology and grain size of the sample; a D/MAX2500VL/PC X-ray diffractometer is used for object imaging analysis (Cu $K_\alpha$, $\lambda$=0.154 nm, scanning speed is 0.05°/s); a AR-600 Rockwell hardness tester is used to measure hardness, a HV-10 Vickers hardness tester is used to test the Vickers hardness of the material, and Shetty fracture toughness calculation formula (see Formula 1 below) is used to calculate the fracture toughness value.

$$KIC=0.0889(HV\cdot P/4L)^{1/2}(\mathrm{MPa\cdot m^{1/2}}).$$ Formula 1:

As can be seen from FIG. 1, the particle size of the (W, Mo, Ta) (C, N) powder is 0.4 to 1.5 μm, and the powder is spherical and the surface thereof is smooth. The energy spectrum of the powder shows that the powder consists of 5 elements including W, Mo, Ta, C and N, indicating that the reaction product is (Ta, Mo, W) (C, N) phase.

Figure 2:
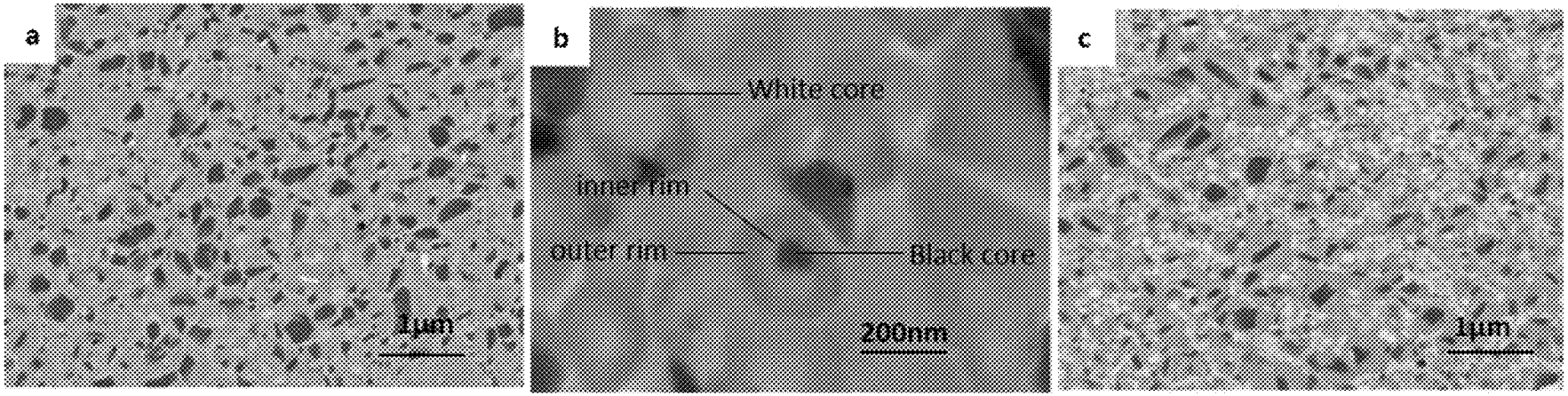
FIG. 2 is a microstructure diagram, wherein a and b of FIG. 2 are the microstructure diagrams of the Ti(C,N)-based superhard metal composite material prepared in Example 1 of the disclosure with different measurement sizes, and c of FIG. 2 is the microstructure diagram of the conventional Ti (C, N) material (that is, without addition of (W, Mo, Ta) (C, N) powder).

According to b of FIG. 2, it can be seen that the microstructure of the Ti(C,N)-based superhard metal composite material as the product of the disclosure exhibits a double-core rim structure with clear black core-white inner rim-gray outer rim/white core-gray rim.

Figure 3:
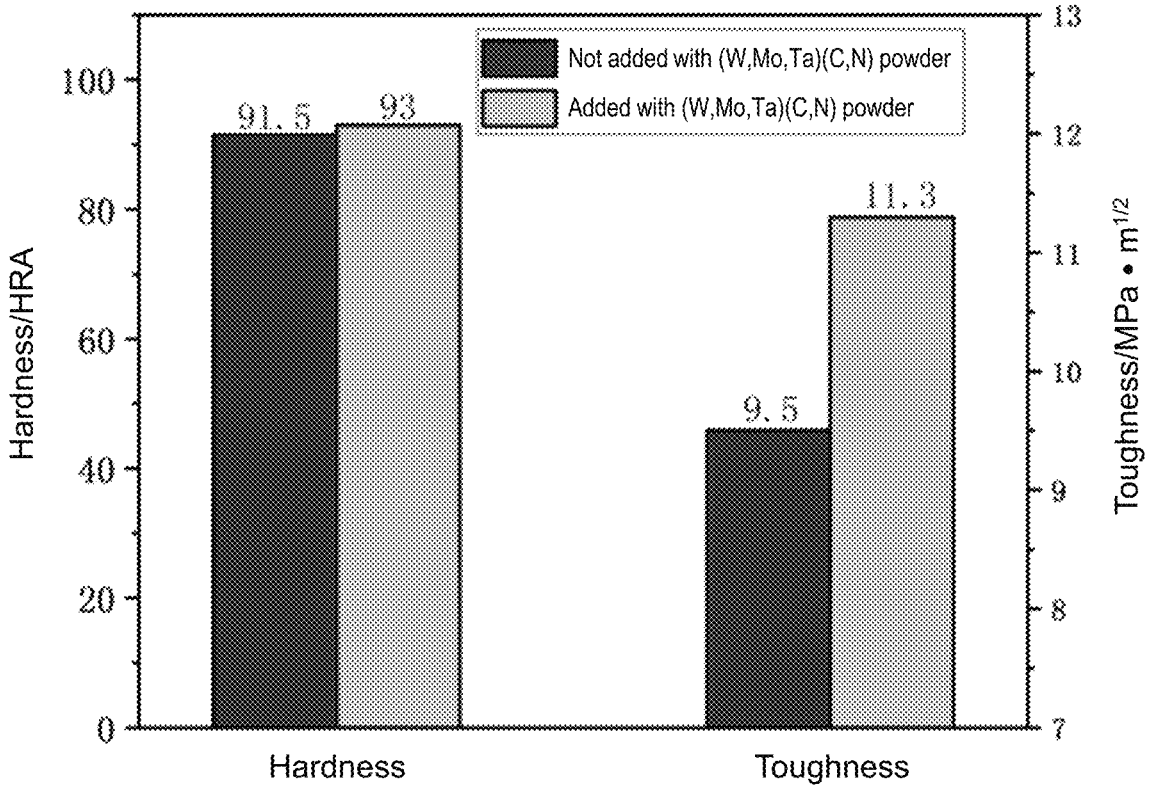
FIG. 3 shows a comparison of mechanical properties of the Ti(C,N)-based superhard metal composite material prepared in Example 1 of the disclosure and the conventional Ti (C, N) material (that is, without addition of (W, Mo, Ta) (C, N) powder).
Figure 4:
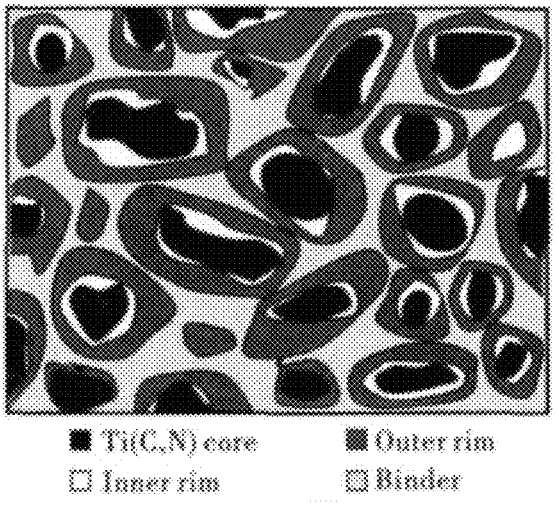
FIG. 4 is a microstructure diagram of the Ti(C,N)-based superhard composite material prepared by the related art.

According to FIG. 3, it can be seen that the Ti(C,N)-based superhard metal composite material sample prepared as the product of the disclosure has significantly increased strength and toughness compared to the conventional superhard metal composite materials, which shows that the superhard metal composite material with double-core rim structure has improved material properties.

Example 2

A preparation method of Ti(C,N)-based superhard metal composite material, which is carried out according to the following steps in sequence:

(1) Based on an amount with mass fractions of 25%, 23%, 15%, and 37%, respectively, weigh the $WO_3$, $MoO_3$, $Ta_2O_5$, and the carbon black having a purity of >99.9% and an average particle size of 10 to 50 μm for batching to obtain a four-component mixed material. The mixed material is placed in a zirconia ceramic tank. Then add PEG-4000 polyethylene glycol which accounts for 8% of the total mass of the above four-component mixed material, and use a planetary ball mill for ball milling, wherein the ball milling medium is n-hexane and the milling ball is a zirconia ball of 7 mm, the ball material mass ratio is 8:1, the rotation speed is 300 r/min, the ball milling is performed for 6 hours. After the ball milling is performed, the slurry is spray dried and then put into the graphite boat, and the carbothermal nitridation reduction reaction is performed in the vacuum tube furnace, wherein $N_2$ atmosphere is adopted, the flow rate is 500 ml/min, the pressure in the furnace is 0.15 MPa, the reduction temperature is 1600° C., the reduction time is 3.5 hours, and finally the (W, Mo, Ta) (C,N) powder is obtained.

(2) Based on an amount with mass fractions of 45%, 40%, and 15%, respectively, weigh the $Ti(C_{0.7},N_{0.3})$ powder and the (W, Mo, Ta) (C, N) powder with fineness of 0.5 to 3 μm and mix them with the Co powder, and then add the paraffin wax which accounts for 3% of the total mass of the mixed powder consisting of the Ti $(C_{0.7},N_{0.3})$ powder, the (W, Mo, Ta) (C, N) powder and the Co powder. Thereafter, the high-energy ball milling is performed by using a planetary ball mill, wherein a ball-to-material ratio is 4:1, a rotation speed is 400 r/min, and the ball milling is performed for 60 hours. After drying, sieving is performed by using a 60 mesh sieve. Then press-forming is performed by using a hydraulic press, and the pressing force is 230 KN. Then sintering is carried out in solid phase at 1150° C., maintain the temperature for 80 minutes, sintering is carried out in liquid phase at 1400° C., maintain the temperature for 70 minutes, then fill in with nitrogen at 8 MPa, then maintain the temperature for 80 minutes, maintain a nitrogen atmosphere and then cool to room temperature in a natural condition. At this stage, the sintering is completed.

Through the same detection method and equipment as adopted in Example 1, it can be obtained that the microstructure of the Ti(C,N)-based superhard metal composite material prepared as the product in this example exhibits a double-core rim structure with clear black core-gray rim/white core-gray rim.

Example 3

A preparation method of Ti(C,N)-based superhard metal composite material, which is carried out according to the following steps in sequence:

(1) Based on an amount with mass fractions of 30%, 20%, 10%, and 40%, respectively, weigh the $WO_3$, $MoO_3$, $Ta_2O_5$, and the carbon black having a purity of >99.9% and an average particle size of 10 to 50 μm for batching to obtain a four-component mixed material. The mixed material is placed in a zirconia ceramic tank. Then add PEG-4000 polyethylene glycol which accounts for 10% of the total mass of the above four-component mixed material, and use a planetary ball mill for ball milling, wherein the ball milling medium is n-hexane and the milling ball is a zirconia ball of 6 mm, the ball material mass ratio is 9:1, the rotation speed is 250 r/min, the ball milling is performed for 4.5 hours. After the ball milling is performed, the slurry is spray dried and then put into the graphite boat, and the carbothermal nitridation reduction reaction is performed in the vacuum tube furnace, wherein $N_2$ atmosphere is adopted, the flow rate is 560 ml/min, the pressure in the furnace is 0.1 MPa, the reduction temperature is 1400° C., the reduction time is 4 hours, and finally the (W, Mo, Ta) (C,N) powder is obtained.

(2) Based on an amount with mass fractions of 40%, 40%, and 20%, respectively, weigh the $Ti(C_{0.6},N_{0.4})$ powder and the (W, Mo, Ta) (C, N) powder with fineness of 0.5 to 3 μm and mix them with the Co powder, and then add the paraffin wax which accounts for 5% of the total mass of the mixed powder consisting of the Ti $(C_{0.6},N_{0.4})$ powder, the (W, Mo, Ta) (C, N) powder and the Co powder. Thereafter, the high-energy ball milling is performed by using a planetary ball mill, wherein a ball-to-material ratio is 3:1, a rotation speed is 500 r/min, and the ball milling is performed for 90 hours. After drying, sieving is performed by using a 60 mesh sieve. Then press-forming is performed by using a hydraulic press, and the pressing force is 200 KN. Then sintering is carried out in solid phase at 1150° C., maintain the temperature for 70 minutes, sintering is carried out in liquid phase at 1450° C., maintain the temperature for 60 minutes, then fill in with nitrogen at 10 MPa, then maintain the temperature for 90 minutes, maintain a nitrogen atmosphere and then cool to room temperature in a natural condition. At this stage, the sintering is completed.

Through the same detection method and equipment as adopted in Example 1, it can be obtained that the microstructure of the Ti(C,N)-based superhard metal composite material prepared as the product in this example exhibits a double-core rim structure with clear black core-white rim/white core-gray rim.

What is claimed is:

1. A preparation method of Ti(C,N)-based superhard metal composite material, wherein Ti(C,N) powder and (W, Mo, Ta)(C,N) powder are adopted as main raw materials, the (W, Mo, Ta)(C,N) powder is added into the Ti(C,N) powder, and a Co powder is adopted as a binding phase, then molding and sintering are performed for preparation, thereby obtaining a double-core rim structure having a microstructure with black core rim and white core rim both; wherein mass fractions of the Ti (C, N) powder, the (W, Mo, Ta) (C, N) powder and the Co powder are 40-50%, 40-50%, 10-20%, respectively; the Ti (C, N) powder, the (W, Mo, Ta) (C, N) powder and the Co powder all have a fineness of 0.5 to 3 μm; specific steps are as follows:

weigh the Ti(C,N) powder and the (W, Mo, Ta) (C, N) powder and mix them with the Co powder based on a proportion described above, and then add a paraffin wax, thereafter high-energy ball milling, drying, sieving, press-forming, sintering are performed; the sintering is carried out in sequence based on the following conditions: carried out in a solid phase at 1150° C., maintain the temperature for 60 to 80 minutes, sintering is carried out in a liquid phase at 1400° C. to 1450° C., maintain the temperature for 60 to 80 minutes, then fill in with nitrogen at 7 to 10 MPa, then maintain the temperature for 60 to 90 minutes, maintain a nitrogen atmosphere and then cool to room temperature.

2. The preparation method of the Ti(C,N)-based superhard metal composite material according to claim 1, wherein an amount of the paraffin wax to be added is calculated based on 3 to 5% of a total mass of the mixed powder consisting of the Ti(C,N) powder, the (W, Mo, Ta) (C, N) powder and the Co powder; the high-energy ball milling is performed by using a planetary ball mill, a ball-to-material ratio is 3 to 6:1, a rotation speed is 300 to 500 r/min, and the ball milling is performed for 48 to 90 hours; the sieving is performed by using a 60 mesh sieve; the press-forming is performed by using a hydraulic press specifically, and a pressing force is 200 to 230 KN.

3. The preparation method of the Ti(C,N)-based superhard metal composite material according to claim 2, wherein the (W, Mo, Ta) (C, N) powder is prepared and obtained according to the following steps: based on an amount with mass fractions of 20-30%, 20-30%, 10-15% and 25-50%, respectively, weigh the $WO_3$, $MoO_3$, $Ta_2O_5$, and the carbon black having a purity of >99.9% and an average particle size of 10 to 50 μm for batching, then add PEG-4000 polyethylene glycol, and use a planetary ball mill for ball milling, and a slurry is spray dried and then put into a graphite boat, and a carbothermal nitridation reduction reaction is performed in a vacuum tube furnace, wherein $N_2$ atmosphere is adopted, and finally (W, Mo, Ta) (C,N) powder is obtained.

4. The preparation method of the Ti(C,N)-based superhard metal composite material according to claim 3, wherein the (W, Mo, Ta) (C, N) powder is prepared and obtained according to the following steps: based on the amount with mass fractions of 20-30%, 20-30%, 10-15% and 25-50%, respectively, weigh the $WO_3$, $MoO_3$, $Ta_2O_5$, and the carbon black having the purity of >99.9% and the average particle size of 10 to 50 μm for batching to obtain the four-component mixed material, then add the PEG-4000 polyethylene glycol which accounts for 4 to 10% of a total mass of the four-component mixed material, and use a planetary ball mill for ball milling, wherein a ball milling medium is n-hexane and a milling ball is a zirconia ball of 5 to 7 mm, a ball material mass ratio is 8 to 10:1, a rotation speed is 200 to 300 r/min, and the ball milling is performed for 4 to 6 hours, after the ball milling is performed, the slurry is spray dried and then put into the graphite boat, and the carbothermal nitridation reduction reaction is performed in the vacuum tube furnace, wherein $N_2$ atmosphere is adopted, a flow rate is 500 to 600 ml/min, a pressure in the furnace is 0.1 to 0.2 MPa, a reduction temperature is 1300° C. to 1600° C., a reduction time is 3 to 4 hours, and finally (W, Mo, Ta) (C,N) powder is obtained.

5. A preparation method of Ti(C,N)-based superhard metal composite material, wherein the method adopts the following raw materials and is performed according to the following steps:

(1) based on an amount with mass fractions of 20-30%, 20-30%, 10-15% and 25-50%, respectively, weigh $WO_3$, $MoO_3$, $Ta_2O_5$, and carbon black having a purity of >99.9% and an average particle size of 10 to 50 μm for batching to obtain a four-component mixed material; then add PEG-4000 polyethylene glycol which accounts for 4 to 10% of a total mass of the four-component mixed material, and use a planetary ball mill for ball milling, wherein a ball milling medium is n-hexane and a milling ball is a zirconia ball of 5 to 7 mm, a ball material mass ratio is 8 to 10:1, a rotation speed is 200 to 300 r/min, and the ball milling is performed for 4 to 6 hours, after the ball milling is performed, a slurry is spray dried and then put into a graphite boat, and a carbothermal nitridation reduction reaction is performed in a vacuum tube furnace, wherein $N_2$ atmosphere is adopted, a flow rate is 500 to 600 ml/min, a pressure in a furnace is 0.1 to 0.2 MPa, a reduction temperature is 1300° C. to 1600° C., a reduction time is 3 to 4 hours, and finally (W, Mo, Ta) (C,N) powder is obtained;

(2) based on an amount with mass fractions of 40-50%, 40-50%, and 10-20%, respectively, weigh the Ti(C,N) powder and the (W, Mo, Ta) (C, N) powder with fineness of 0.5 to 3 μm and mix them with a Co powder, and then add a paraffin wax which accounts for 3 to 5% of a total mass of the mixed powder consisting of the Ti (C, N) powder, the (W, Mo, Ta) (C, N) powder and the Co powder, thereafter the high-energy ball milling is performed by using the planetary ball mill, wherein the ball-to-material ratio is 3 to 6:1, the rotation speed is 300 to 500 r/min, and the ball milling is performed for 48 to 90 hours, after drying, sieving is performed by using a 60 mesh sieve, then press-forming is performed by using a hydraulic press, and a pressing force is 200 to 230 KN, then sintering is carried out in a solid phase at 1150° C., maintain the temperature for 60 to 80 minutes, sintering is carried out in a liquid phase at 1400° C. to 1450° C., maintain the temperature for 60 to 80 minutes, then fill in with nitrogen at 7 to 10 MPa, then maintain the temperature for 60 to 90 minutes, maintain a nitrogen atmosphere and then cool to room temperature.

* * * * *